US005831474A

United States Patent [19]

Thiel, V et al.

[11] Patent Number: 5,831,474

[45] Date of Patent: Nov. 3, 1998

[54] VOLTAGE REGULATOR AND METHOD OF CONSTRUCTION FOR A CMOS PROCESS

[76] Inventors: Frank L. Thiel, V, 6802 Old Quarry La., Austin, Travis County, Tex. 78731; Roy A. Hastings, 902 Morningside La., Allen, Collin County, Tex. 75002

[21] Appl. No.: 744,116

[22] Filed: Nov. 5, 1996

Related U.S. Application Data

[60] Provisional application No. 60/006,289 Nov. 7, 1995.

[51] Int. Cl. [6] ..... G05F 1/10

[52] U.S. Cl. ..... 327/541; 327/540; 327/542; 327/543; 323/315

[58] Field of Search ..... 327/538, 539, 327/540, 541, 542, 543; 323/312, 315

*Primary Examiner*—Terry Cunningham
*Attorney, Agent, or Firm*—Christopher L. Maginniss; W. James Brady, III; Richard L. Donaldson

[57] ABSTRACT

A voltage regulator (10) is provided. A first bipolar transistor (24) has an emitter connected to a first node (NODE 6) and a base connected to a second node (NODE 5). A second bipolar transistor (30) is scaled N:1 with respect to the first bipolar transistor (24), N greater than one. The second bipolar transistor (30) has an emitter, a base, and a lateral collector. The base is connected to the second node (NODE 5). A first resistor (20) is connected between the first node (NODE 6) and an output node (NODE 2). A second resistor (32) is connected between the first node (NODE 6) and the emitter of the second bipolar transistor (30), and a third resistor (22) is connected between the first node (NODE 6) and a ground node (GND). A current sensing amplifier (12, 14, 34, 38 and 40) has a first input node (NODE 7) connected to the lateral collector of the first bipolar transistor (24) and a second input node (NODE 8) connected to the lateral collector of the second bipolar transistor (30). The current sensing amplifier (12, 14, 34, 38 and 40) is operable to match emitter currents through the first and second bipolar transistors (24 and 30). The voltage regulator (10) is operable to produce a temperature stable output voltage level ($V_{OUT}$) at the output node that is settable to a desired voltage level.

14 Claims, 1 Drawing Sheet

VOLTAGE REGULATOR AND METHOD OF CONSTRUCTION FOR A CMOS PROCESS

This application claims priority under 35 USC § 119(e) (1) of provisional application No. 60/006,289 filed Nov. 7, 1995.

TECHNICAL FIELD OF THE INVENTION

This invention relates in general to the field of electronic circuits, and more particularly to a voltage regulator and method of construction for a CMOS process.

BACKGROUND OF THE INVENTION

In a typical CMOS process, the only bipolar device available is a parasitic bipolar structure. While this device can be built to conduct current laterally, the majority of the current is collected by the substrate. This is due to the lack of a high concentration buried layer. Such a buried layer is not present in a typical CMOS process but is commonly used in a BiCMOS process. In a p-substrate process, such a bipolar device is a PNP transistor having a lateral collector and a strong parasitic vertical collector tied to the substrate.

It can be desirable to use a CMOS-only process to construct a voltage regulator circuit. The CMOS process allows the production of a less expensive product than can be produced using a BiCMOS process. However, when constructing a voltage regulator a bipolar device is required by conventional designs in order to produce an accurate voltage reference.

Consequently, in a conventional CMOS design, either the emitter or base of the bipolar transistors are sensed with a voltage amplifier to produce a voltage reference. The use of a voltage amplifier introduces error due to the offset of the amplifier. A typical voltage regulator design requires several circuit blocks including, at the minimum, the voltage reference circuit, an error voltage amplifier, and feedback circuitry. All of this circuitry uses power, therefore it reduces the efficiency of the voltage regulator. Another concern is temperature stability. Conventional designs have balanced temperature coefficients to produce temperature stable outputs but require a bipolar supply and are limited to an integer multiple of the silicon band-gap voltage for minimum temperature coefficient voltage outputs.

SUMMARY OF THE INVENTION

Therefore a need has arisen for a voltage regulator requiring less current than that required by conventional designs but also providing an accurate voltage output and constructable in a CMOS process.

In accordance with the present invention a voltage regulator and method of construction for a CMOS process are provided that substantially eliminate or reduce disadvantages and problems associated with previously developed voltage regulators.

In one embodiment of the present invention, a voltage regulator is provided. A first bipolar transistor has an emitter, a base, and a lateral collector. The emitter is connected to a first node and the base is connected to a second node. A second bipolar transistor is scaled N:1 with respect to the first bipolar transistor, N greater than one. The second bipolar transistor has an emitter, a base, and a lateral collector. The base is coupled to the second node. A first resistor is connected between the first node and an output node. A second resistor is connected between the first node and the emitter of the second bipolar transistor, and a third resistor is connected between the first node and the ground node. A current sensing amplifier has a first input node connected to the lateral collector of the first bipolar transistor and a second input node connected to the lateral collector of the second bipolar transistor. The current sensing amplifier is operable to match the emitter currents through the first and second bipolar transistors. The voltage regulator is operable to produce a temperature stable output voltage level at the output node that is settable to a desired voltage level.

A technical advantage of the present invention is the construction of a voltage regulator in a CMOS process that has a temperature compensated output voltage settable to a desired level above a voltage level equal to twice the band-gap voltage of silicon. The output voltage is not limited to an integer multiple of the band-gap voltage.

Another technical advantage of the present invention is the provision of a temperature stable voltage regulator constructed in a CMOS process.

A further technical advantage of the present invention is the provision of an accurate voltage reference having less sensitivity to temperature, power supply, and process variations as well as being more power efficient, stable, reliable and less expensive.

BRIEF DESCRIPTION OF THE DRAWINGS

A more complete understanding of the present invention and advantages thereof may be acquired by referring to the following descriptions taken in conjunction with the accompanying drawings in which like reference numbers indicate like features and therein.

DETAILED DESCRIPTION OF THE INVENTION

Figure 1:
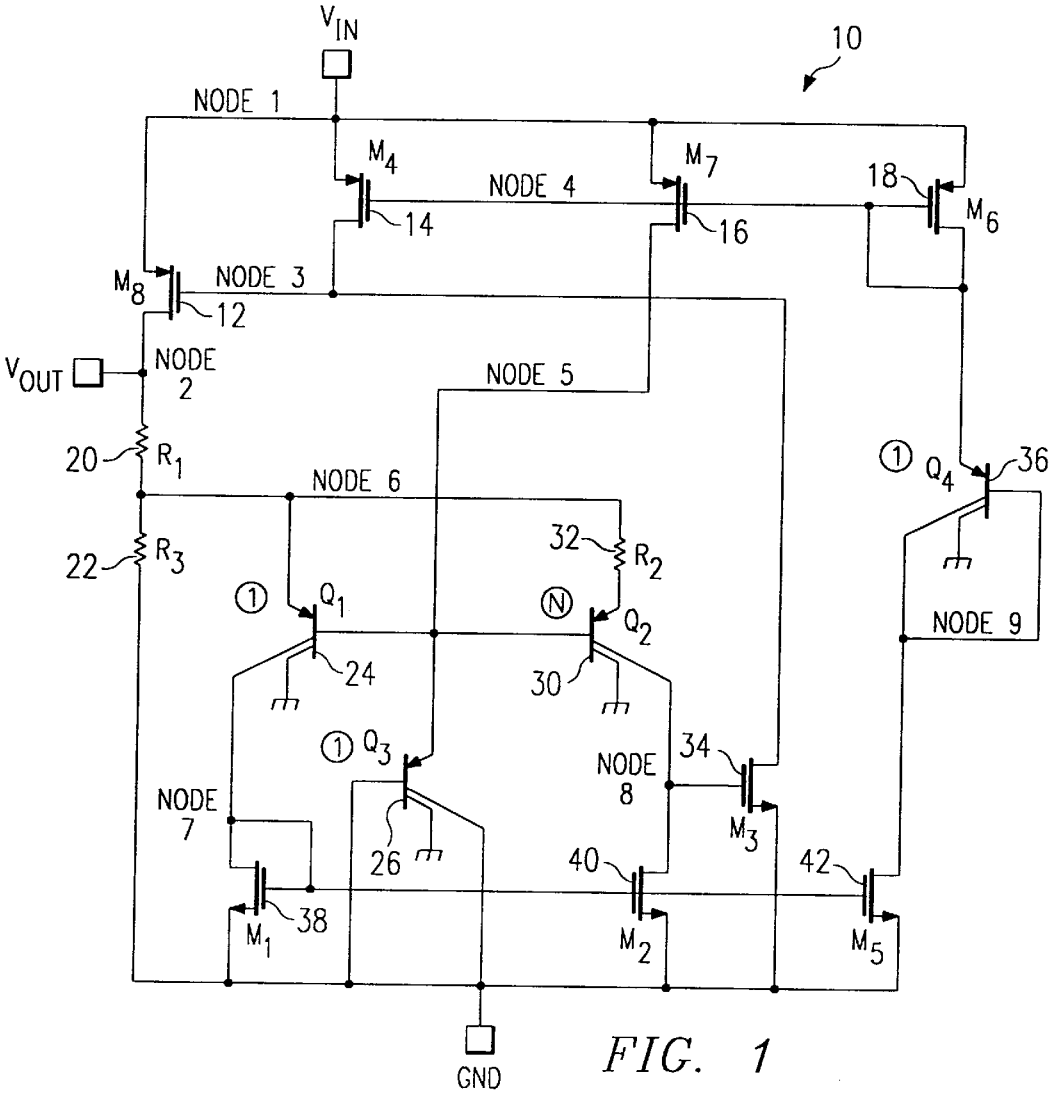
FIG. 1 illustrates a circuit diagram of one embodiment of a voltage regulator for a CMOS process constructed according to the teachings of the present.

FIG. 1 illustrates a circuit diagram of a voltage regulator for a CMOS process, indicated generally at 10, constructed according to the teachings of the present invention.

Voltage regulator 10 comprises a first P-channel MOSFET 12 having a source connected to the first node, NODE 1, a drain connected to a second node, NODE 2, and a gate connected to a third node, NODE 3. A second P-channel MOSFET 14 has a source connected to NODE 1, a drain connected to NODE 3, and a gate connected to a fourth node, NODE 4. A third P-channel MOSFET 16 has a source connected to NODE 1, a gate connected to NODE 4, and a drain connected to a fifth node, NODE 5. A fourth P-channel MOSFET 18 has a source connected to NODE 1, a gate connected to NODE 4, and a drain connected to NODE 4.

In voltage regulator 10, a first resistor 20 is connected between NODE 2 and a sixth node, NODE 6. A second resistor 22 is connected between NODE 6 and a ground node, GND. A first PNP transistor 24 has an emitter connected to NODE 6, a base connected to NODE 5, a vertical collector connected to the substrate, and a lateral collector connected to a seventh node, NODE 7. A second PNP transistor 26 has an emitter connected to NODE 5, a base connected to the ground node, a vertical collector connected to the substrate, and a lateral collector connected to the ground node.

It should be understood that the vertical collector is inherently part of the structure of a lateral bipolar device constructed in a CMOS only process such as the PNP transistors of voltage regulator 10. A cross-section of the structure of such a PNP transistor is illustrated and described in more detail with respect to FIG. 2.

A third PNP transistor 30 has a base connected to NODE 5 and an emitter connected to a third resistor 32. Third resistor 32 is connected between NODE 6 and the emitter of PNP transistor 30. PNP transistor 30 also has a vertical collector connected to the substrate and a lateral collector connected to an eighth node, NODE 8. As shown, PNP transistor 30 is constructed to have a collection ratio of N:1 with respect to PNP transistor 24, where N is greater than one. According to the teachings of the present invention, PNP transistor 30 is constructed as N copies of the structure of PNP transistor 24. In one embodiment of the present invention, N is set equal to 8.

A first N-channel MOSFET 34 has a gate connected to NODE 8, a drain connected to NODE 3 and a source connected to the ground node. A fourth PNP transistor 36 has an emitter connected to NODE 4, a base connected to a ninth node, NODE 9, a vertical collector connected to the substrate, and a lateral collected connected to NODE 9. A second N-channel MOSFET 38 has a drain connected to NODE 7, a gate connected to NODE 7, and a source connected to the ground node. A third N-channel MOSFET 40 has a drain connected to NODE 8, a gate connected to NODE 7, and a source connected to the ground node. A fourth N-channel MOSFET 42 has a drain connected to a ninth node, NODE 9, a gate connected to NODE 7, and a source connected to the ground node.

In operation, voltage regulator 10 operates to provide a settable and temperature stable output voltage level at an output node $V_{OUT}$. The output voltage level is settable to a desired level above a voltage level equal to twice the band-gap voltage of silicon. The output voltage is not limited to an integer multiple of the band-gap voltage level of silicon. Voltage regulator 10 operates to match the currents through PNP transistors 24 and 30 to generate an accurate and settable voltage reference. Current sensing is used eliminating the inaccuracy created by a voltage amplifier in conventional designs. N-channel MOSFETs 38, 40 and 34 and P-channel MOSFETs 12 and 14 constitute a current sensing amplifier operable to keep the currents through PNP transistors 30 and 24 matched and having NODE 7 and NODE 8 as input nodes.

In operation, voltage regulator 10 generates known ratioed $V_{BE}$'s in PNP transistors 24 and 30 in order to produce a $\Delta V_{BE}$ current reference which forms a basis for the band-gap voltage reference. The same current flows through PNP transistors 24 and 30, but PNP transistor 30 has a collection ratio of N:1 with respect to PNP transistor 24. Thus, there are mismatched current densities in PNP transistors 24 and 30. Consequently, the $V_{BE}$'S for PNP transistors 24 and 30 differ by a known amount.

The voltage difference $\Delta V_{BE}$ is established across resistor 32 to produce a current that has a linear positive temperature coefficient. That current has a linear positive temperature coefficient because the $V_{BE}$ of PNP transistor 30 decreases faster than the $V_{BE}$ of PNP transistor 24 as temperature increases. The voltage across resistor 22 produces a current having a linear negative temperature coefficient because both $V_{BE}$'s decrease with increasing temperature.

The $V_{BE}$ of each PNP transistor is logarithmically related to the total collector current density, both through the lateral collector and the vertical collector. So, for a given transistor, $$V_{BE} = \frac{KT}{q} \left[ \log \frac{J_{CVAT} + J_{CVERT}}{J_S} \right]$$

where, $J_{CVAT}$=lateral current density $J_{CVERT}$=vertical current density, and $J_S$=saturation current density PNP transistor 32 is matched as N copies of PNP transistor 24, thus the ratio from lateral collected current to vertical collected current is the same for both. The lateral current collected by PNP transistors 24 and 30 is sensed and forced to be equal. Consequently, the total current collected by each is the same. Because the current densities are different, the $V_{BE}$'s for PNP transistors 24 and 30 differ by a known amount.

The insertion of resistor 22 allows the output voltage level to be adjusted and set to a value above twice the band-gap voltage of silicon. This value can be any desired value and is not limited to an integer multiple of the band-gap voltage.

Voltage regulator 10 of the present invention eliminates conventional regulator circuit blocks by providing a voltage regulator as an integral part of the voltage reference. The output voltage reference level is the output of the regulator which eliminates any need for a separate error amplifier block or voltage error amplifier and improves power efficiency. Further, voltage regulator 10 of the present invention does not require a bipolar power supply and provides a single circuit that performs conventional regulator and reference functions as opposed to conventional circuits which require multiple circuit blocks and/or supplies.

In voltage regulator 10, PNP transistors 24, 26, 30 and 36-are matched, where PNP transistor 30 is formed to have a ratio N:1 to PNP transistor 24. Further, P-channel MOSFETs 14, 16 and 18 are matched, and N-channel MOSFETs 38, 40 and 42 are matched. In addition, resistors 20, 22 and 32 are constructed from the same material and are made the same width.

In operation, PNP transistor 24 and PNP transistor 30 have their currents balanced by the current sensing amplifier to provide a known base-emitter voltage differential, $\Delta V_{BE}$. This $\Delta V_{BE}$ constitutes a reference voltage level used to generate a current with a positive temperature coefficient. The emitter currents of PNP transistors 24 and 30 are regulated by the current is sensing amplifier formed by N-channel MOSFETs 34, 38 and 40 and P-channel MOSFETs 12 and 14. This eliminates the need for an additional amplifier of conventional designs. In addition, PNP transistor 26 provides extra headroom for N-channel MOSFETs 38, 40 and 42 to operate and eliminates a need for a bipolar voltage supply. Only one voltage supply is needed.

Voltage regulator 10 sets a minimum temperature compensated voltage reference level to twice the band-gap voltage of silicon or approximately 2.4 volts. N-channel MOSFET 42 and PNP transistor 36 form a current mirror/multiplier circuit. Together, N-channel MOSFET 42 and PNP transistor 36 operate to set the drain current of P-channel MOSFET 18 and the drain current of P-channel MOSFET 16, and therefore the emitter current of PNP transistor 26.

PNP transistor 36 operates to regenerate an equivalent current to that flowing through PNP transistor 24 and PNP transistor 30. Thus, PNP transistor 36 operates to run PNP transistor 26 at the same current level as PNP transistors 24 and 30, matching the $V_{BE}$ of PNP transistor 26 to that of PNP transistor 24.

The current flowing through resistor 32 has a positive temperature coefficient, while the current flowing through resistor 22 has a negative temperature coefficient. By balancing these currents, the temperature coefficient of the voltage across resistor 20 can be chosen to match the temperature coefficient of the added $V_{BE}$'s of PNP transistors 24 and 26 at any desired output voltage. This provides the temperature stable voltage reference output, $V_{OUT}$.

N-channel MOSFET 34 and P-channel MOSFET 14 comprise a voltage gain stage. P-channel MOSFET 12 allows the input voltage $V_{IN}$ to reach close to the output voltage $V_{OUT}$, which gives a low drop-out voltage regulator functionality. The following equation gives the value for the output voltage $V_{OUT}$ (assuming the transistors are substantially in forward bias, the total collector currents match, and there is a significantly high loop gain in the feedback loop around the voltage reference).

$$V_{out} = \left[ \frac{2kT}{q} \cdot \frac{R_1}{R_2} \cdot \ln(N) \right] + \left[ \left( 1 + \frac{R_1}{R_3} \right) (V_{BE1} + V_{BE3}) \right]$$

(Note: $V_{BE1}=V_{BE3}$ since $I_{CTOTAL1}=I_{CTOTAL3}$ and the devices are matched)

So, $$V_{out} = 2 \left[ \frac{kT \cdot \ln(N)}{q} \cdot \frac{R_1}{R_2} + \left( \frac{R_3 + R_1}{R_3} \right) (V_{BE1}) \right]$$

In order to determine the values for resistor 20, resistor 22 and resistor 32, that give a minimum temperature coefficient at the desired $V_{OUT}$, then the first derivative of the above equation with respect to temperature is set equal to zero at a given temperature. This ensures that the linear component of the change in output voltage $V_{OUT}$ with respect to temperature is zero at that temperature. Thus, $$\frac{dV_{out}}{dT} = 0$$

$$\frac{dV_{out}}{dT} = 2 \left[ \frac{k \cdot \ln(N)}{q} \cdot \frac{R_1}{R_2} + \left( \frac{R_3 + R_1}{R_3} \right) \frac{dV_{BE1}}{dT} \right] = 0$$

Therefore, $$\frac{k \cdot \ln(N)}{q} \cdot \frac{R_1}{R_2} = -\left( \frac{R_3 + R_1}{R_3} \right) \frac{dV_{BE1}}{dT}$$

In order to choose a value for resistor 32, a desired emitter current flowing through lateral PNP transistor 30 is selected. In one embodiment of the present invention, this current is one micro-amp at room temperature. After a solution is found for resistor 32, the values for resistors 20 and 22 are determined by simultaneously solving the above two equations: $V_{OUT}$ equal to the desired voltage and the derivative of $V_{OUT}$ equal to zero.

The present invention provides a very low current complete voltage regulator that does not require a MOS voltage amplifier which otherwise would reduce accuracy due to its input offset voltage. Further, an external set of feedback multiplier resistors is not required to generate $V_{OUT}$. Voltage regulator 10 is fully adjustable and has a low drop-out voltage.

Figure 2:
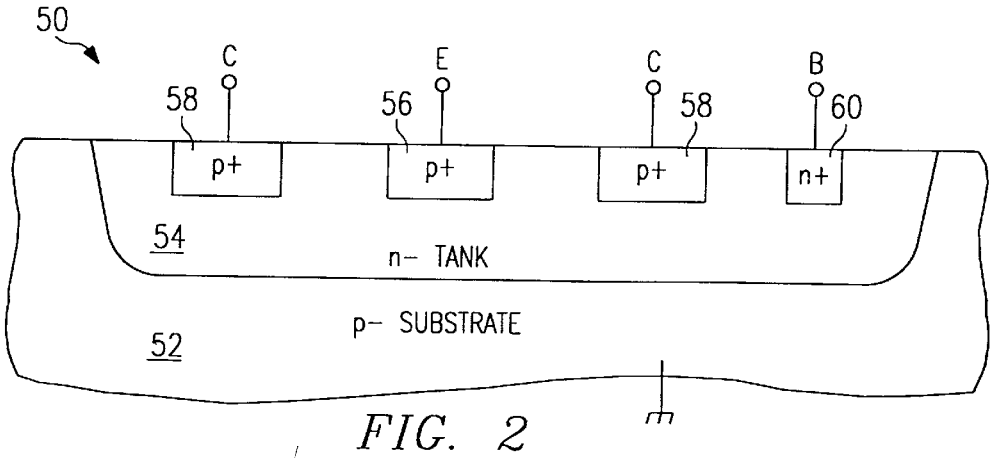
FIG. 2 illustrates a cross-sectional view of a lateral PNP transistor in a CMOS process.

FIG. 2 illustrates a cross section of a lateral PNP transistor in a CMOS process with its associated substrate parasitic, indicated generally at 50. PNP transistor 50 comprises a P-substrate region 52 having an N-tank 54 formed therein. Emitter region 56 is formed in N-tank 54 and comprises p+ region. Similarly, collector regions 58 are formed in the N-tank 54 and comprise p+ regions. A base contact region 50 is formed in N-tank 54 and comprises an n+ region.

In operation, N-tank 54 is the base, collector regions 58 are the collector, and emitter region 56 is the emitter of PNP transistor 50. Further, the P-substrate 52 acts as a secondary collector and may often have a higher collection ratio than the lateral collector regions 58. In this embodiment, the P-substrate 52 is connected to ground potential.

Although the present invention has been described in detail, it should be understood that various changes, substitutions and alterations can be made hereto without departing from the spirit and scope of the invention as defined by the appended claims.

What is claimed is:

1. A voltage regulator, comprising:

a first bipolar transistor having an emitter, a base, and a lateral collector, the emitter connected to a first node and the base connected to a second node;

a second bipolar transistor scaled N:1 with respect to the first bipolar transistor, N greater than one, the second bipolar transistor having an emitter, a base, and a lateral collector, where the base is connected to the second node;

a first resistor connected between the first node and an output node;

a second resistor connected between the first node and the emitter of the second bipolar transistor;

a third resistor connected between the first node and a ground node; and a current sensing amplifier having a first input node connected to the lateral collector of the first bipolar transistor and a second input node connected to the lateral collector of the second bipolar transistor, and having a first output node connected to the second node and a second output node coupled to the output node, the current sensing amplifier operable to match emitter currents through the first and second bipolar transistors such that the voltage regulator is operable to produce a temperature stable output voltage level at the output node that is settable to a desired voltage level.

2. The voltage regulator of claim 1, wherein the current sensing amplifier comprises a third bipolar transistor having an emitter, a base, and a lateral collector, the emitter connected to the second node, the base connected to a ground node, and the lateral collector connected to a ground node.

3. The voltage regulator of claim 1, wherein the current sensing amplifier further comprises a current reference output substantially equal to a lateral collector current of the first bipolar transistor, and the voltage regulator further comprising:

a third bipolar transistor having an emitter, a base, and a lateral collector, the emitter connected to the second node, the base connected to the ground node, and the lateral collector connected to a ground node; and a fourth bipolar transistor having an emitter, a base, and a lateral collector, the base and lateral collector connected to the current reference output and the emitter coupled to the emitter of the third bipolar transistor through a mirroring circuit which will reflect a current into the emitter of the third bipolar transistor substantially equal to the emitter current of the fourth bipolar transistor.

4. The voltage regulator of claim 1, wherein the lateral collector of the first bipolar transistor is coupled to the ground node through a first MOS transistor in the current sensing amplifier.

5. The voltage regulator of claim 1, wherein the lateral collector of the second bipolar transistor is coupled to the ground node through a second MOS transistor in the current sensing amplifier.

6. The voltage regulator of claim 1, wherein the first bipolar transistor and the second bipolar transistor comprise PNP transistors.

7. A voltage regulator formed in a CMOS process, comprising:

a first PNP transistor having an emitter, a base, and a lateral collector, the emitter connected to a first node and the base connected to a second node;

a second PNP transistor scaled N:1 with respect to the first PNP transistor, N greater than one, the second PNP transistor having an emitter, a base, and a lateral collector, where the base is connected to the second node;

a first resistor connected between the first node and an output node;

a second resistor connected between the first node and the emitter of the second PNP transistor; and a third resistor connected between the first node and a ground node;

a third PNP transistor having an emitter, a base, and a lateral collector, the emitter connected to the second node, the base connected to the ground node, and the lateral collector connected to the ground node; and a current sensing amplifier having a first input node connected to the lateral collector of the first PNP transistor and a second input node connected to the lateral collector of the second PNP transistor, and having a first output node connected to the second node and a second output node coupled to the output node, the current sensing amplifier operable to match emitter currents through the first and second PNP transistors such that the voltage regulator is operable to produce a temperature stable output voltage level at the output node that is settable to a desired voltage level.

8. The voltage regulator of claim 7, wherein the current sensing amplifier further comprises a current reference output substantially equal to a lateral collector current of the first bipolar transistor, and the voltage regulator further comprising:

a fourth bipolar transistor having an emitter, a base, and a lateral collector, the base and lateral collector connected to the current reference output and the emitter coupled to the emitter of the third bipolar transistor through a mirroring circuit which will reflect a current into the emitter of the third-bipolar transistor substantially equal to the emitter current of the fourth bipolar transistor.

9. A method for construction of a voltage regulator in a CMOS process, comprising:

forming a first bipolar transistor having an emitter, a base, and a lateral collector, and connecting the emitter to a first node and the base to a second node;

forming a second bipolar transistor scaled N:1 with respect to the first bipolar transistor, N greater than one, and having an emitter, a base, and a lateral collector, and connecting the base to the second node;

connecting a first resistor between the first node and an output node;

connecting a second resistor between the first node and the emitter of the second bipolar transistor;

connecting a third resistor connected between the first node and a ground node; and forming a current sensing amplifier operable to match emitter currents through attached bipolar transistors and having a first input node and a second input node, and connecting the first input node to the lateral collector of the first bipolar transistor and connecting the second input node to the lateral collector of the second bipolar transistor, and having a first output node and second output node, and connecting the first output node to the second node and the second output node to the output node, such that the voltage regulator is operable to produce a temperature stable output voltage level at the output node that is settable to a desired voltage level.

10. The method of claim 9, further comprising forming a third bipolar transistor having an emitter, a base, and a lateral collector, and connecting the emitter to the second node, the base to the ground node, and the lateral collector to the ground node.

11. The method of claim 9, wherein forming the current sensing amplifier further comprises forming a current reference output of the current sensing amplifier having a magnitude substantially equal to a lateral collector current of the first bipolar transistor, and the method further comprising:

forming a third bipolar transistor having an emitter, a base, and a lateral collector, and connecting the emitter to the second node, the base to the ground node, and the lateral collector to the ground node; and forming a fourth bipolar transistor having an emitter, a base, and a lateral collector, the base and lateral collector connected to the current reference output and the emitter coupled to the emitter of the third bipolar transistor through a mirroring circuit which will reflect a current into the emitter of the third bipolar transistor substantially equal to the emitter current of the fourth bipolar transistor.

12. The method of claim 9, wherein connecting the lateral collector of the first bipolar transistor comprises connecting the lateral collector to the ground node through a first MOS transistor in the current sensing amplifier.

13. The method of claim 9, wherein connecting the lateral collector of the second bipolar transistor comprises connecting the lateral collector to the ground node through a second MOS transistor in the current sensing amplifier.

14. The method of claim 9, wherein forming the first bipolar transistor and the second bipolar transistor comprises forming bipolar PNP transistors.

* * * * *